US006410914B1

(12) United States Patent
Park et al.

(10) Patent No.: US 6,410,914 B1
(45) Date of Patent: Jun. 25, 2002

(54) IONIZATION CHAMBER FOR ATMOSPHERIC PRESSURE IONIZATION MASS SPECTROMETRY

(75) Inventors: Melvin A. Park; Houle Wang, both of Billerica; Frank Laukien, Lincoln, all of MA (US)

(73) Assignee: Bruker Daltonics Inc., Billerica, MA (US)

( * ) Notice: Subject to any disclaimer, the term of this patent is extended or adjusted under 35 U.S.C. 154(b) by 0 days.

(21) Appl. No.: 09/263,659

(22) Filed: Mar. 5, 1999

(51) Int. Cl.[7] ..... H01J 49/04
(52) U.S. Cl. ..... 250/288; 250/285; 250/282
(58) Field of Search ..... 250/282, 288, 250/288 A, 285

(56) References Cited

U.S. PATENT DOCUMENTS

| | | | | |
|---|---|---|---|---|
| 3,831,026 A | | 8/1974 | Powers et al. | |
| 4,403,147 A | | 9/1983 | Melera et al. | |
| 4,812,040 A | * | 3/1989 | Marcus et al. | 250/288 |
| 5,030,826 A | | 7/1991 | Hansen | |
| 5,304,798 A | | 4/1994 | Tomany et al. | |
| 5,360,910 A | | 11/1994 | Huang et al. | |
| 5,436,446 A | | 7/1995 | Jarrell et al. | |
| 5,495,108 A | | 2/1996 | Apffel, Jr. et al. | |
| 5,668,370 A | * | 9/1997 | Yano et al. | 250/288 |
| 5,736,741 A | | 4/1998 | Bertsch et al. | |
| 5,750,988 A | | 5/1998 | Apfell et al. | |
| 5,753,910 A | | 5/1998 | Gourley et al. | |
| 5,756,994 A | * | 5/1998 | Bajic | 250/288 |
| 5,838,003 A | | 11/1998 | Bertsch et al. | |
| 5,844,237 A | * | 12/1998 | Whitehouse et al. | 250/288 |
| 6,066,848 A | * | 5/2000 | Kassel et al. | 250/288 |

FOREIGN PATENT DOCUMENTS

| | | |
|---|---|---|
| GB | 1 318 400 A | 5/1973 |
| JP | 61 082647 A | 4/1986 |
| JP | 61 245455 A | 10/1986 |

OTHER PUBLICATIONS

Kelner et al: "Secondary Emission Mass Spectrometer. Application and evaluation" Int,J, Mass Spectrom. Ion Proc., vol. 62, No. 3, Dec. 31, 1984, pp. 234–251, XP000017109.

Zhou J et al: "A Dual Ion Source to Produce CS+ or I– Ions For Secondary Ion Mass Spectrometry" Int,J,Mass Spectrom. Ion Proc., vol. 146/147, No. 1, Aug. 31, 1995, pp. 139–145, XP000538945 ISSN: 0168–1176.

* cited by examiner

*Primary Examiner*—Jack Berman
(74) *Attorney, Agent, or Firm*—Ward & Olivo

(57) ABSTRACT

The ionization chamber consists of a plurality of ports to accept multiple identical devices or varying devices. Ports may be arranged at various positions on the ionization chamber and at various angles with respect to the sampling orifice leading into the vacuum chamber of the mass spectrometer. A plurality of sprayers may operate in a time modulated manner and thereby the simultaneous multiplexed analysis of a multitude of samples is facilitated.

41 Claims, 12 Drawing Sheets

IONIZATION CHAMBER FOR ATMOSPHERIC PRESSURE IONIZATION MASS SPECTROMETRY

FIELD OF THE INVENTION

The invention relates generally to mass spectrometry and specifically to atmospheric pressure mass spectrometry and enhanced ionization chambers which employ multiple ports for accepting any type of sprayer, lamp, microscope, camera or other such device in various combinations.

BACKGROUND OF THE INVENTION

Mass spectrometry is an important tool in the analysis of a wide range of chemical compounds. Specifically, mass spectrometers can be used to determine the molecular weight of sample compounds. The analysis of samples by mass spectrometry consists of three groups of steps—formation of gas phase ions from sample material, mass analysis of the ions to separate the ions from one another according to ion mass, and detection of the ions. A variety of means exist in the field of mass spectrometry to perform each of these three functions. The particular combination of means used in a given spectrometer determine the various characteristics of that spectrometer.

To perform mass analysis of ions, for example, one might use a magnetic (B) or electrostatic (E) analyzer, and specifically a combination of both. Ions passing through a magnetic or electrostatic field will follow a curved path. In a magnetic field the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers.

Before mass analysis can begin, however, gas phase ions must be formed from sample material. If the sample material is sufficiently volatile, ions may be formed by electron impact (EI) or chemical ionization (CI) of the gas phase sample molecules. For solid samples (e.g. semiconductors, or crystallized materials), ions can be formed by desorption and ionization of sample molecules by bombardment with high energy particles. Secondary ion mass spectrometry (SIMS), for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample—e.g. the molecular weight of sample molecules—will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commoun.* 60 (1974) 616). Macfarlane et al. discovered that the impact of high energy (MeV) ions on a surface, like SIMS would cause desorption and ionization of small analyte molecules, however, unlike SIMS, the PD process results also in the desorption of larger, more labile species—e.g. insulin and other protein molecules.

Lasers have been used in a similar manner to induce desorption of biological or other labile molecules. See, for example, VanBreeman, R. B.: Snow, M.: Cotter, R. J., *Int. J. Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R. J., *Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, analyte is dissolve in a solid, organic matrix. Laser light of a wavelength that is absorbed by the solid matrix but not by analyte is used to excite the sample. The matrix is excited directly by the laser. The excited matrix sublimes into the gas phase carrying with it the analyte molecules. The analyte molecules are ionized by proton, electron, or cation transfer from the matrix molecules to the analyte molecules. MALDI is typically used in conjunction with time-of-flight mass spectrometry (TOFMS) and can be used to measure the molecular weights of proteins in excess of 100,000 daltons.

It is also known in the prior art to utilize ultrasonic transducers to break up a liquid sample jet into liquid droplets. For example, Miyagi et al., U.S. Pat. No. 4,112,297, disclose a nebulizer which includes an ultrasonic transducer used to create the particle beam. Melera et al,, U.S. Pat. No. 4,403,147, incorporate an acoustic transducer, such as a piezoelectric transducer which may be used to stimulate the probe to break up the liquid stream.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

ESMS was introduced by Yamashita and Fenn (M. Yamashita and J. B. Fenn, *J. Phys. Chem.* 88, 4671, 1984). To establish this combination of ESI and MS, ions had to be formed at atmospheric pressure, and then introduced into the vacuum system of a mass analyzer via a differentially pumped interface. The combination of ESI and MS afforded scientists the opportunity to mass analyze a wide range of samples. ESMS is now widely used primarily in the analysis of biomolecules (e.g. proteins) and complex organic molecules.

In the intervening years a number of means and methods useful to ESMS and API-MS have been developed. Much work has been centered on sprayers and ionization chambers.

For example, Tomany, et al. U.S. Pat. No. 5,304,798 converts an electrospray received from an electrospray apparatus into an ion stream of ions, vapor and gas via a certain housing configuration. The ion stream may be directed through a skimmer, a separate pressure reduction stage and into an analytical apparatus capable of measuring the mass-to-charge spectrum of the sample.

In addition to the original electrospray technique, pneumatic assisted electrospray, dual electrospray, and nano electrospray are now also widely available. Pneumatic assisted electrospray (A. P. Bruins, T. R. Covey, and J. D. Henion, Anal. Chem. 59, 2642,1987) uses nebulizing gas flowing past the tip of the spray needle to assist in the formation of droplets. The nebulization gas assists in the formation of the spray and thereby makes the operation of the ESI easier. Nano electrospray (M. S. Wilm, M. Mann, *Int. J. Mass Spectrom. Ion Processes* 136, 167, 1994) employs a much smaller diameter needle than the original electrospray. As a result the flow rate of sample to the tip is lower and the droplets in the spray are finer. However, the ion signal provided by nano electrospray in conjunction with MS is essentially the same as with the original electrospray. Nano electrospray is therefore much more sensitive with respect to the amount of material necessary to perform a given analysis.

The design of the ionization chamber used in conjunction with API-MS has had a significant impact on the availability and use of these ionization methods with MS.

Various apparatuses have been proposed to improve efficiency in mass spectrometry by reducing or controlling the ion flow from the ionization chamber which in turn improves the quality of the interaction between the sample and the mass detection apparatus within the vacuum system. For example, Jarrell, et al. U.S. Pat. Nos. 5,306,910 and 5,436,446 use a time modulated electrospray by the application of a time modulated voltage to an element positioned opposite the electrospray means and analyzer. This is said to reduce sample waste and maintain a low electric potential.

Apffel et al. U.S. Pat. Nos. 5,495,108 and 5,750,988 present apparatuses which increases the enrichment of the analyte entering the vacuum. This is apparently achieved through orthogonal ion sampling whereby charged droplets are sprayed past a sampling orifice while directing the solvent vapor and solvated droplets in a direction such that they do not enter the vacuum system.

Hanson U.S. Pat. No. 5,030,826 discusses an apparatus which redirects vapor spray residue into a coaxial flow system in order to eliminate the necessity for a separate ion outlet port. This is said to simplify maintenance and facilitate vacuum sealing of the components.

Another example of quality control improvements in ionization chambers is discussed in Bertsch, et al. U.S. Pat. No. 5,736,741. Cleaning, maintenance and inspection are facilitated by providing a capillary assembly which may be removed without tools. Bertsch et al. also disclose improvement in the electrical stability of the electrospray ionization chamber by providing an asymmetric electrode. The asymmetric electrode configuration is said to prevent unevaporated droplets and condensation from being trapped, thereby minimizing the chances of electrical breakdown, shorting, arcing or distortion.

Prior art ionization chambers are inflexible to the extent that a given ionization chamber can be used readily with only a single ionization method and a fixed configuration of sprayers. For example, in order to change from a simple electrospray method to a nano electrospray method of ionization, one had to remove the electrospray ionization chamber from the source and replace it with a nano electrospray chamber (see also, Gourley et al., Angled Chamber Seal for Atmospheric Pressure Ionization Mass Spectrometry, U.S. Pat. No. 5,753,910). Thus, a need exists for an ionization chamber which maximizes flexibility and efficiency of use as between various types of samples and analytical methods.

SUMMARY OF THE INVENTION

The present invention provides an ionization chamber having a plurality of ports. The ports can be identical in diameter, length and orientation if, for example, a series of identical devices are to be used in the ports. Alternatively, the diameter, length and orientation of a port may be different from one or more of the other ports. In the embodiments of the present invention which use differing ports, different devices may be used and/or different angles may be used to direct the electrospray, for example. Other embodiments include the use of the plurality of ports in a time modulated manner.

OBJECTS OF THE INVENTION

One object of the present invention is to provide an ionization chamber which has improved flexibility over prior art atmospheric pressure ionization chambers. The ionization chamber according to the present invention has a plurality of ports at predetermined locations and orientations on the body of the ionization chamber. The ports accept devices which are designed to fit the ports and work with the ionization chamber. Such devices include not only various types of sprayers, but also lamps, microscopes, cameras, and other such devices. The sprayers may be of any conceivable type including simple electrospray, pneumatically assisted electrospray, nano electrospray, or an APCI probe. Such sprayers may or may not be in electrical contact with the ionization chamber.

In one embodiment of the invention, the ports are all the same size so that a given device may be readily moved from one port to another. By moving a sprayer from one port to another, one may change its position and/or orientation with respect to the sampling orifice. Further, one type of sprayer may be readily exchanged with another according to the requirements of a measurement.

According to another object of the invention, a means is provided to use a plurality of sprayers simultaneously in a single ionization chamber and on a single ion source. The sprayers may be oriented symmetrically or asymmetrically about the sampling orifice which leads to the mass spectrometer. The sprayers need not be all producing ions (or a spray) simultaneously even though a multitude of sprayers are present on the ionization chamber. Also, the sprayers need not be identical. Rather, some of the sprayers might be, for example, pneumatically assisted whereas others are nano electrosprayers or simple electrosprayers.

According to yet another object of the present invention, a method of using a plurality of sprayers simultaneously on a single ionization chamber and on a single ion source is taught. The sprayers need not be all producing ions (or a spray) simultaneously even though a plurality of sprayers are present on the ionization chamber. Rather the spray from any or all of the sprayers may be time modulated. Further, any given sprayer may produce ions in a manner that is synchronous or asynchronous with the spray from any or all of the other sprayers. By operating the sprayers in an asynchronous manner, analyte from a multitude of inlets may be sampled in a multiplexed manner. The resultant multiplexed data may be deconvoluted after acquisition to reconstruct the ion signal from each of the sprayers.

In an additional object of the present invention, various sprayers might be used to perform differing functions. For example, one sprayer may be used to spray a reference standard while other sprayers are used simultaneously to spray analyte. The reference standard would then appear in any mass spectra and might be used to mass calibrate the spectra. As another example, one sprayer may be used to provide neutral or ionized chemical reagents into the ionization chamber. Ions or neutrals from other sprayers may react with the reagent, with products observed via a mass spectrometer.

According to another object of the present invention, the use of said ionization chamber and/or a multitude of sprayers together with chromatographic sample preparation is provided. Such chromatographic sample preparation may be, for example, liquid chromatography, or capillary electrophoresis. The effluent from such a chromatographic column may be injected directly or indirectly into one of the sprayers. A plurality of such chromatographic columns may be used in conjunction with a plurality of sprayers—for example, one sprayer per column. The presence of analyte in the effluent of any given column might be detected by any appropriate means, for example, a UV detector. When analyte is detected in this way, the sprayer associated with the column in question is "turned on" so that while analyte is present the sprayer is producing ions but otherwise the sprayer does not. If analyte is present simultaneously at more than one sprayer, the sprayers are multiplexed as described above.

According to another object of the present invention, the said ionization chamber and/or multitude of sprayers may be used together with a mass analyzer. This includes the sampling of the ions via an orifice or capillary which leads into the vacuum system of the analyzer. In the vacuum system, ions are transferred through a series of differential pumping stages and into high vacuum region wherein ion analysis occurs. Any mass analyzer might be used including TOF, ICR, quadrupole, magnetic or electric sectors, or quadrupole ion traps.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

DETAILED DESCRIPTION OF THE PREFERRED EMBODIMENT

Figure 1:
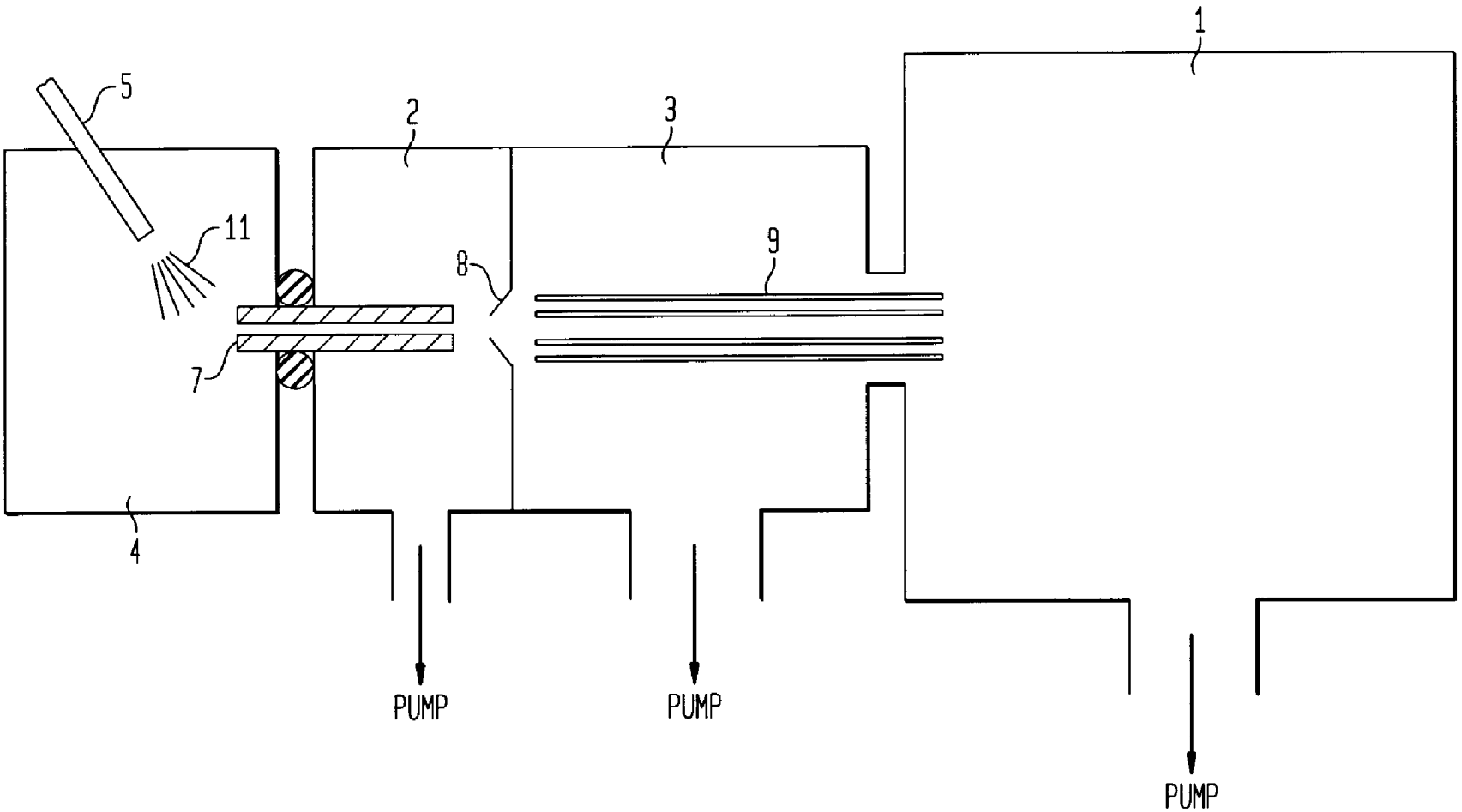
FIG. 1 depicts a diagram of the use of API with a mass analyzer.

With regard to FIG. 1, an ESI mass spectrometer is depicted. Ions are produced from sample material in an ionization chamber 4. Sample solution enters the ionization chamber through a spray needle 5, at the end of which the solution is formed into a spray of fine droplets 11. The spray is formed as a result of an electrostatic field applied between the spray needle 5 and a sampling orifice 7. The sampling orifice may be an aperture, capillary, or other similar inlet leading into the vacuum chamber 2 of the mass spectrometer. Electrosprayed droplets 11 evaporate while in the ionization chamber 4 thereby producing gas phase analyte ions. Heated drying gas may be used to assist the evaporation of the droplets 11. Some of the analyte ions are carried with the gas from the ionization chamber 4 through the sampling orifice 7 and into the vacuum system of the mass spectrometer depicted as 1,2 and 3. With the assistance of electrostatic lenses and/or RF driven ion guides 9, ions pass through a differential pumping system before entering the high vacuum region 1 wherein the mass analyzer resides. Once in the mass analyzer, the ions are mass analyzed to produce a mass spectrum.

Figure 2:
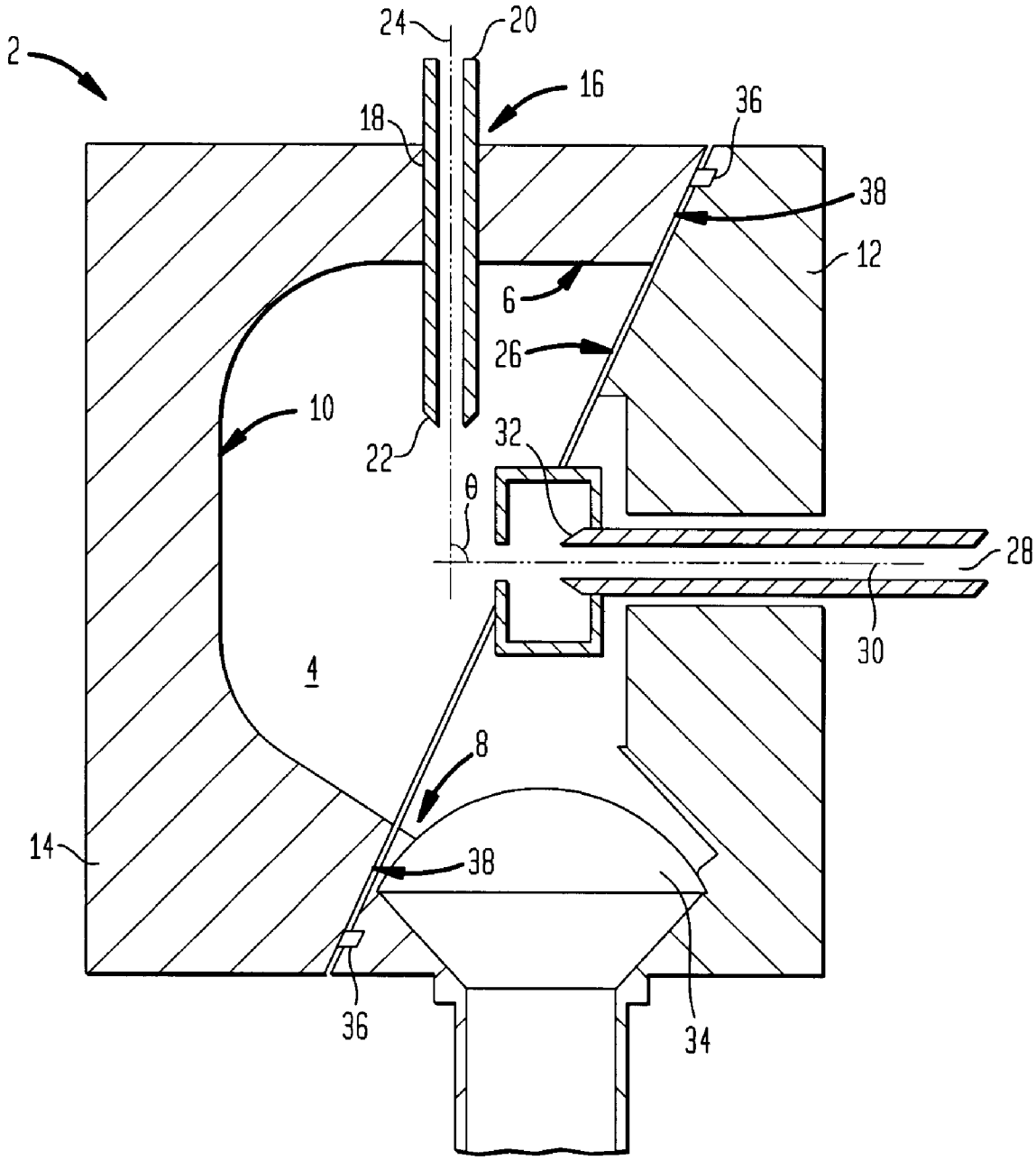
FIG. 2 (PRIOR ART)
FIG. 2 depicts a prior art ionization chamber suitable for ESI.
Figure 3:
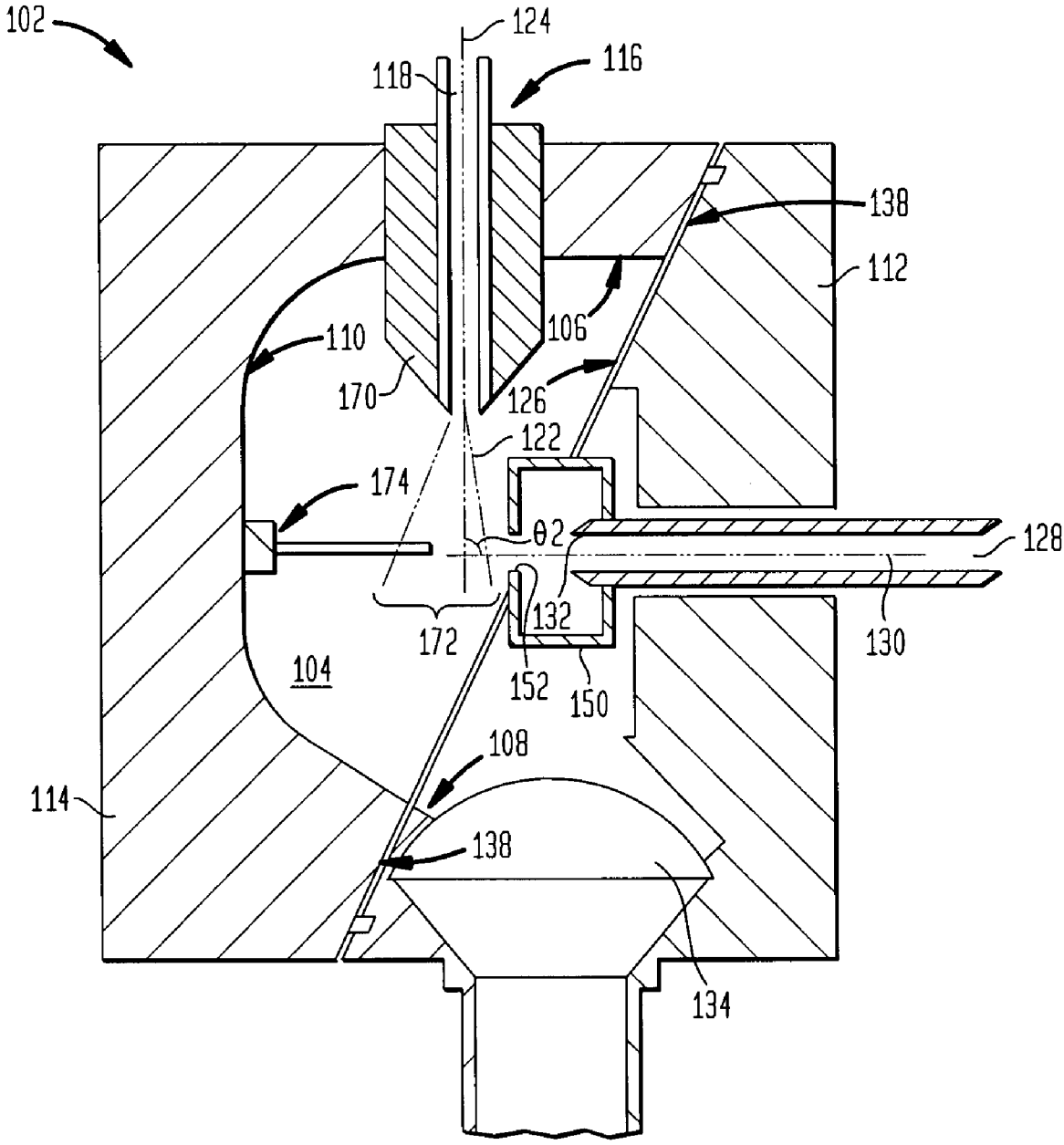
FIG. 3 (PRIOR ART)
FIG. 3 depicts a diagram of a prior art ionization chamber suitable for APCI.

The ionization chamber 4 is thus an integral and important part of an ESI mass spectrometer. Among other aspects, its design in terms of the placement of the sprayer and the integration of the ionization sprayer in the chamber 4 will in part determine the performance of the mass spectrometer as a whole, what types of experiments can be performed, and how these experiments are performed. As an example, a prior art ionization chamber is depicted in FIG. 2 as reference numeral 2. The ionization chamber 2 depicted in FIG. 2 is composed of two sections separated by line 38. The base block 12 is the assembly on the right side of line 38 and the removable cover 14 is on the left side of line 38. A fixed base contains the orifice 30, comprising entrance 32 and exit 28 which leads into the vacuum system of the mass spectrometer (not shown). The other section is a removable cover 14 which includes a sprayer 18 comprising an entrance 24 and an exit 22 or other ionization apparatus—e.g. APCI. The prior art cover assembly 14 is designed in such a way that only a single sprayer can be used. Further, in order to change the ionization method by changing, for example sprayer 18, the cover 14 must be exchanged. That is, a given cover 14 is dedicated to a specific type of ionization method. FIG. 2 depicts the cover 14 required for electrospray ionization whereas FIG. 3 depicts the cover 114 required for atmospheric pressure chemical ionization (APCI). The APCI apparatus is shown in the diagram as corona discharge needle 174 and APCI probe 116. In order to switch between the two methods, one cover has to be removed from the base and the other put in its place. Similarly, in order to use nano electrospray, a different experimental arrangement must be used.

Figure 4A:
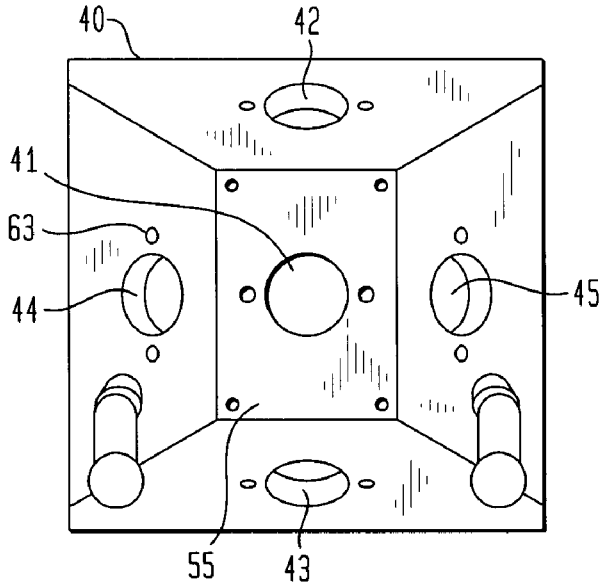
FIG. 4 depicts the preferred embodiment ionization chamber.
Figure 4B:
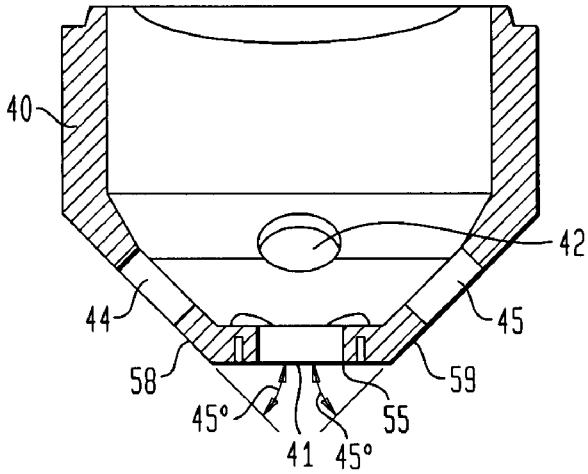
Figure 4C:
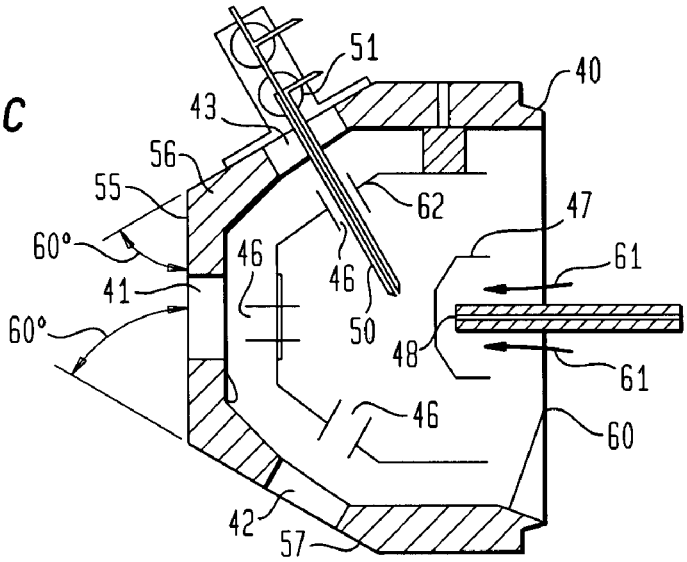

FIGS. 4A–C depict three views of the preferred embodiment of the ionization chamber according to the present invention. According to the present invention, the cover 40 has a multitude of ports 41,42,43,44 and 45. These ports can accept a variety of devices 51 designed for or adapted to this ionization chamber design. These devices 51 may include a multitude of sprayers or ionization probes, or other devices such as lamps, microscopes, or cameras. In the preferred embodiment, the ports 41,42,43,44,45 are all the same size so any device 51 that can be mounted on one port can also be mounted on any of the other ports 41,42,43,44,45. This adds flexibility to the arrangement in that the types and number of devices 51, and their positions and orientations with respect to each other and with respect the sampling orifice 48 can readily be selected by the user.

Figure 5A:
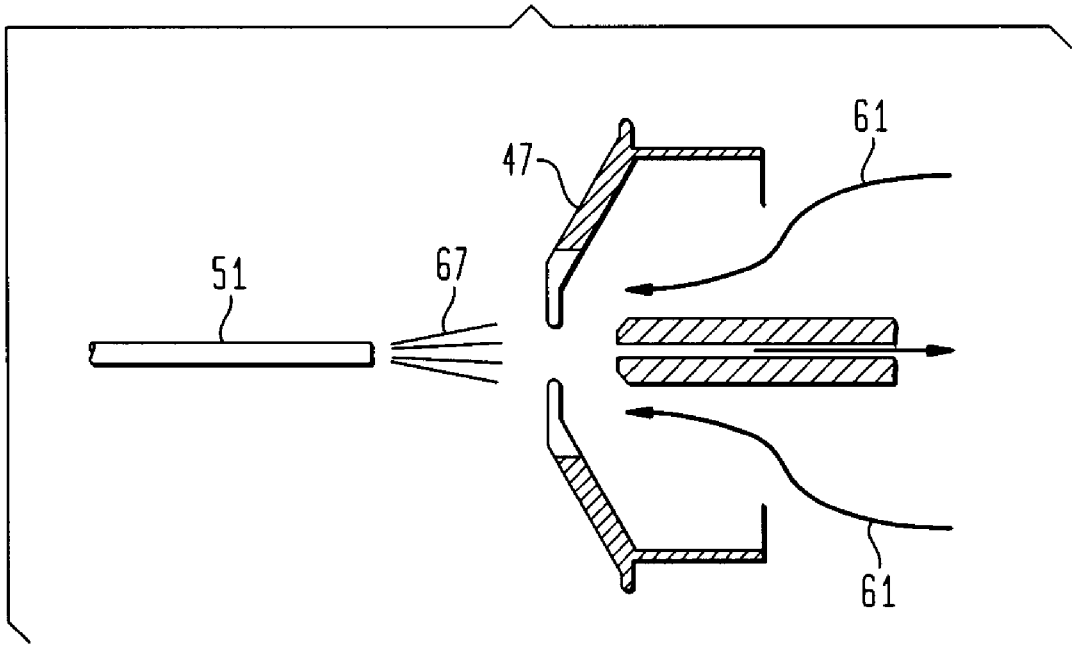
FIG. 5*a* depicts a cross-sectional depiction of the endcap.
Figure 5B:
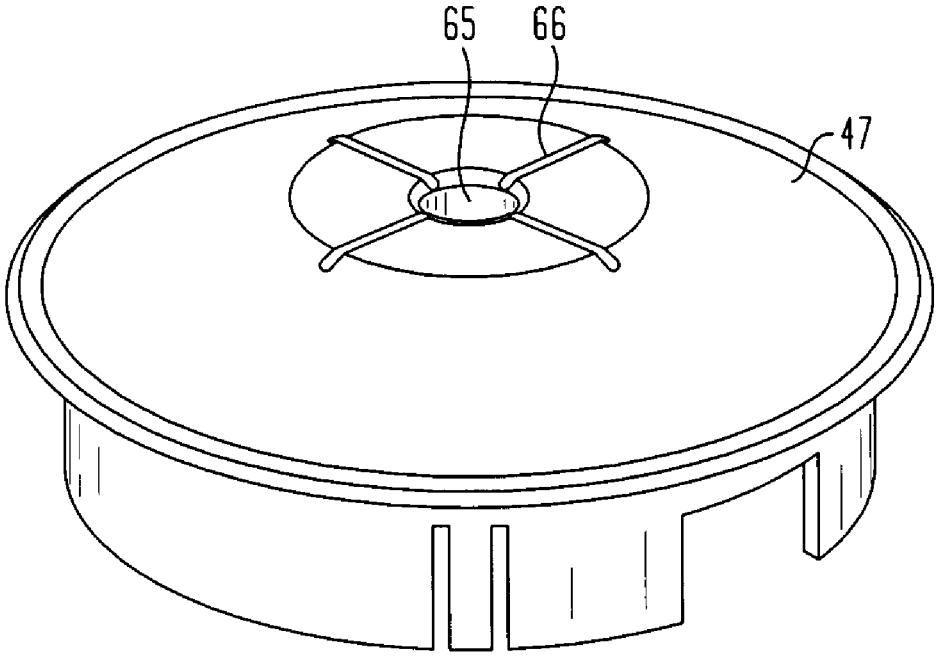
FIG. 5*b* depicts the endcap showing the aperture and slits through which drying flows.

The base 60 on which the cover 40 is mounted includes a sampling orifice 48 which may be an aperture, a capillary, or other similar device. In the preferred embodiment, an "endcap" 47 electrode is mounted over the orifice 48 and directs the flow of heated gas 61 which is used to assist the drying of sprayed droplets 67 (FIG. 5*a*). The electric field established between the endcap 47, the sampling orifice 48, and the spray needle 50 also assists in directing ions into the sampling orifice 48. In the preferred embodiment of the ionization chamber, the endcap 47 has four slits 66 in its exit aperture 65 (FIG. 5*b*). The center of exit aperture 65 is in line with port 41 and the slits 66 are aligned with the ports 41,42,43,44,45 in the cover 40 and thereby the sprayers 51. The gas 61 emitted from the slits 66 can therefore intercept the sprayed droplets 67 from any of the four off axis positions described below. The droplets 67 are thus in contact with heated drying gas 61 for a longer period of time as they move from the needle 50 to the orifice 48 than would be possible using an endcap 47 without these slits 66.

The cover 40 may be removed from the base 60 for, for example, cleaning or other maintenance. However, when mounted, preferably the cover 40 is centered on the orifice 48 such that port 41 and orifice 48 are in a single axis. The preferred embodiment of the ionization chamber in accordance with the present invention has five ports oriented at three angles with respect to the sampling orifice. A single port, the "zero degree" port 41, is located in line with the orifice 48 and the plane 55 of the cover 40 on which this port 41 is located is perpendicular to the orifice 48. A flange (not shown) mounted on this port 41 and having a spray needle centered on the flange and oriented perpendicular to the surface of the flange would thus result in a spray needle which is coaxial with and centered on the sampling orifice 48. The remaining four ports are centered around port 41. In the preferred embodiment, one pair of ports (ports 42–43) are contained in planes 57–56, respectively, of cover 40 which are each oriented at a first angle (depicted in FIG. 4C as 60° ports) with respect to the plane 55. The second pair of ports (ports 44–45) are contained in planes 58–59, respectively, of cover 40 which are each oriented at a second angle (depicted in FIG. 4B as 45° ports) with respect to the plane 55. Ports 42 and 43 (the first pair) are located on opposite sides of port 41 on cover 40. Ports 44 and 45 (the second pair) are located on opposite sides of port 41 on cover 40 and are oriented such that the first pair are oriented orthogonal to the second pair, as shown in FIG. 4A.

The preferred embodiment ionization chamber according to the present invention also includes a "high voltage shield" 62. As depicted in FIG. 4C, the high voltage shield 62 is preferably an electrode located just within the ionization chamber cover 40 and has substantially the same shape as the cover 40. The high voltage shield 62 includes a plurality of holes 46 positioned adjacent to the ports 41,42,43,44,45 on the cover 40 such that for example, needles 50 or other such devices 51 as are mounted on the cover 40 can project through the high voltage shield 62 without contacting the high voltage shield 62. In the preferred embodiment, the high voltage shield 62 is held at the same potential as the endcap 47. The presence of high voltage shield 62 results in the formation of a higher strength field at the tip of the spray needle 50. This effect is especially important when more than one sprayer is used. The presence of the high voltage shield 62 increases the field strength at the needle tips so that a spray 67 (FIG. 5A) can be obtained from all the sprayers.

Figure 6A:
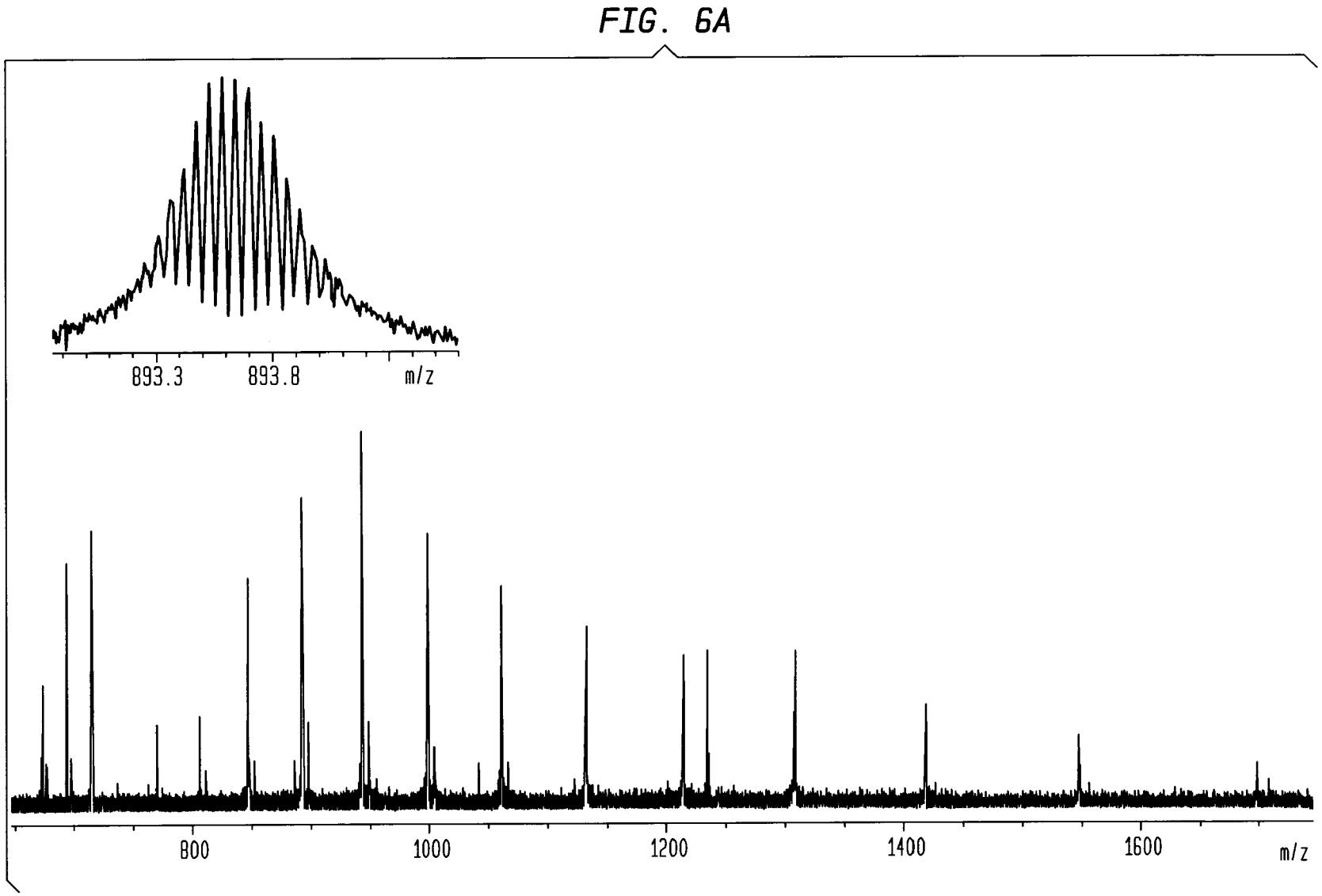
FIG. 6*a* presents mass spectral data in conjunction with ICR MS.
Figure 6B:
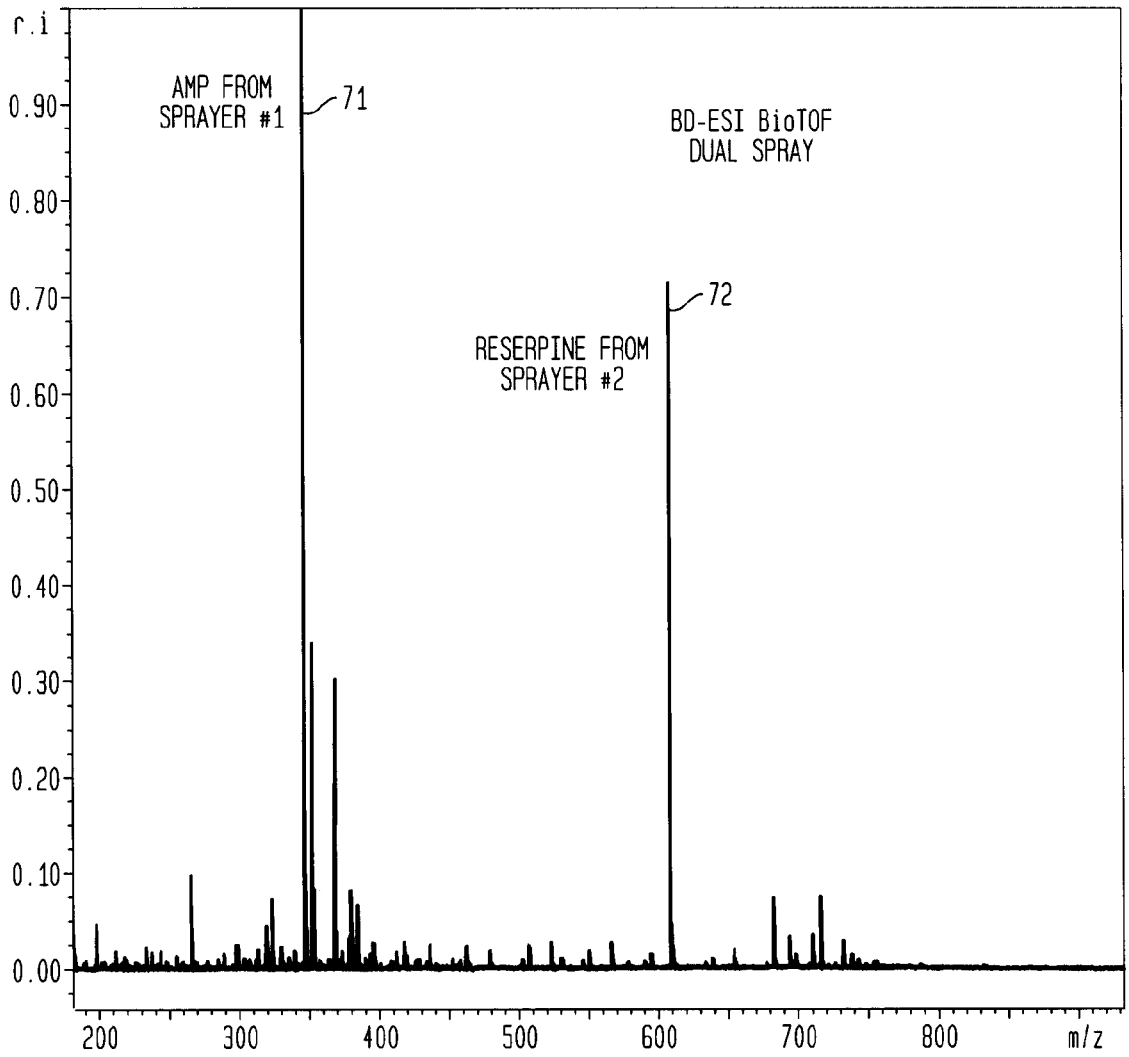
FIG. 6*b* presents mass spectral data from a dual spray system in conjunction with TOF MS.

FIG. 6*a* shows the results of a measurement made using an ICR mass spectrometer with the preferred embodiment ionization chamber. In this case a single pneumatically assisted ESI sprayer was used in one of the 45° ports (i.e., ports 44 or 45 of FIGS 4A–C). Similar results were obtained using the same sprayer in one of the 60° ports (i.e., port 42 or 43 of FIGS. 4A–C). FIG. 6*b* shows the results of a measurement made using a TOF mass spectrometer with the preferred embodiment ionization chamber and two pneumatically assisted ESI sprayers. In this case the two sprayers were mounted on the two 45° ports (i.e., port 44 or 45 of FIGS. 4A–C). A sample of adenosine monophosphate was sprayed from one sprayer while a sample of rescerpine was sprayed from the other. The two peaks 71 and 72 appearing in the spectrum of FIG. 6*b* indicate the presence of ions from these two samples.

Mounting the sprayers opposite one another and at the same angle that is, if a device 51 having needle 50 were positioned in port 42 in substantially the same manner as in port 43, as shown in FIG. 4C has the particular advantage that the electric field near the needle 50 and between the needle 50 and the sampling orifice 48 is the same for the two sprayers. As a result, the intensity of the sprays produced by the two sprayers will tend to be equal. According to the preferred embodiment, one could perform the same experiment by mounting the sprayers on opposing 60° ports 44 and 45 (see FIG. 4B). The results of FIG. 6 demonstrate the flexibility of the ionization chamber according to the present invention. Specifically, devices 51 may be moved readily from one port to another—and thereby from one orientation to another—as required by the experiment to be performed.

It is of course understood by those having skill in the art that the overall concept of the invention is the use of interchangeable ports. These ports may or may not be all utilized simultaneously. Additionally, the chamber may be constructed with fewer than or more than four or five ports as exemplified herein, although possibly not the most efficient configuration available.

It should be noted that other sprayers—e.g. a nano ESI sprayer—could be mounted on the preferred embodiment cover 40. Also a corona discharge needle and nebulizer could be mounted via two separate flanges in order to perform atmospheric pressure chemical ionization (APCI) experiments. APCI has the advantage over ESI that it is much less dependent upon analyte concentration and works well with smaller molecules. Further, more than two sprayers might be used—in the preferred embodiment up to five sprayers might be used.

Alternate embodiment ionization chambers may have any number of ports and/or spray needles positioned in any desired orientation with respect to each other and the sampling orifice. Further the ports may be of any differing sizes. Also, though it is assumed above that the spray needle is perpendicular to the face of the flange and therefore the orientation of the port determines the orientation of the sprayer, such need not be the case. Rather, the spray needle might be offset from the center of its flange or the spray needle might be mounted on the flange at an angle not normal to the flange surface. If such a sprayer were mounted on the zero degree port of the preferred embodiment ionization chamber, the spray tip might not be aligned and parallel with the sampling orifice. Having the spray tip offset from the sampling orifice has the advantage that ions may still be directed into the orifice whereas unevaporated droplets would be less likely to enter the orifice. In that such droplets account, to a large extent, for the contamination of the orifice and lenses in the differential pumping region of the vacuum system, it is desirable that such droplets not enter the orifice.

It is further possible that the sprayer and/or spray needle not be in electrical contact with the flange or the ionization chamber cover. Notice that in the preferred embodiment the cover is in electrical contact with the base during normal operation and that the base is in contact with ground potential. If isolated from the cover, the potential on each individual sprayer might be controlled independently by additional power supplies. In this case the spray from any given sprayer may be "turned on" if the potential difference between such sprayer and orifice is in a normal range as described above, or "turned off" if such potential difference be set below the threshold. A time modulated electric field can be applied to control each of sprayers in such a way that at any given moment, only certain sprayers are "turned on" while others are "turned off". This can be advantageous especially in circumstances where sample throughput—i.e. the number of samples per unit time—is an issue. Prior art mass spectrometers are capable of acquiring as many as ten spectra per second. In some rare cases this high rate of data acquisition has been used to the full. One such example is in the analysis of samples by high speed LC/ESMS (C. M. Whitehouse, R. N. Dreyer, M. Yamashita, J. B. Fenn, *Anal. Chem.* 57, 675, 1985). In this case a sample mixture is introduced into a liquid chromatography column. The effluent from the column is injected directly into a sprayer where it is electrosprayed. The resulting ions are mass analyzed at a high rate of speed such that a sequence of spectra are produced corresponding to the evolution of the chromatographic separation.

Figure 7:
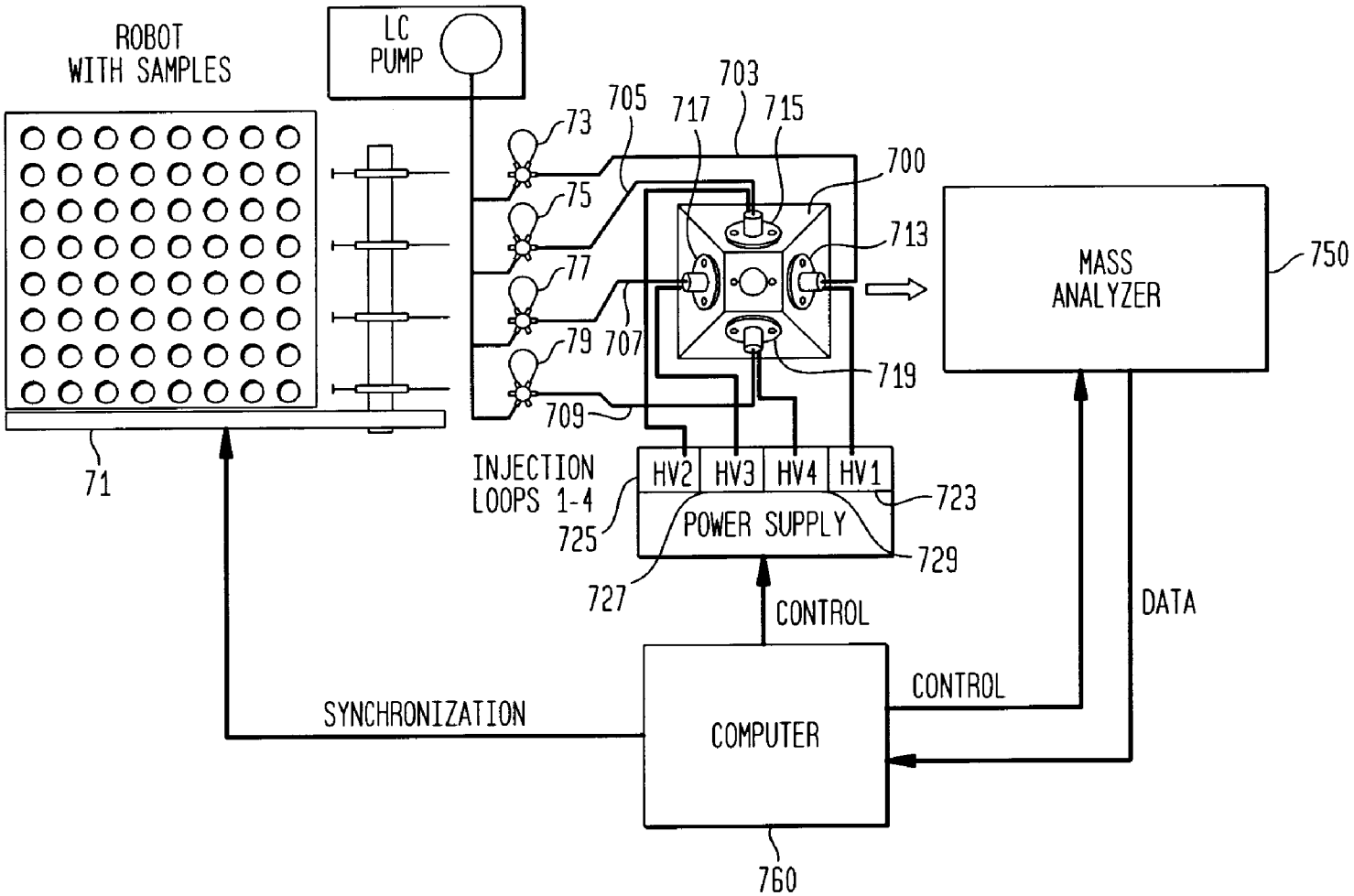
FIG. 7 is a schematic of the setup for sample injection using a robot.

However, in a more typical analysis, wherein only a single mass spectrum is desired—i.e. without chromatographic separation of analyte constituents—for each of a large number of samples, prior art apparatuses have not been able to take full advantage of the speed of modern spectrometers. For example, robots have been used in conjunction with various types of ESMS spectrometers. Such robots will, for example, inject aliquots of a large number of samples sequentially onto a sample transfer line which ultimately leads to the electrospray mass spectrometer. However, much of the time associated with a sample analysis in such prior art systems is associated with the time required for samples to flow from the robot, through the transfer line, to the sprayer. The multiple sprayers taught by the present invention affords the opportunity to multiplex the sample analysis. That is, one can use a multitude of sprayers and therefore a multitude of sample transfer lines in conjunction with one or more sample injection robots as depicted in FIG. 7. As depicted, one embodiment of this system uses a single robot 71, four injection loops 73, 75, 77 and 79, four transfer lines 703, 705, 707 and 709, and four sprayers 713, 715, 717 and 719 in a ionization chamber 700 according to the present invention. The sprayers 713, 715, 717 and 719 are electrically isolated from the ionization chamber 700 and the potential on each sprayer is controlled via high voltage power supplies 723, 725, 727 and 729. As discussed previously, sample ions from the sprayers 713, 715, 717 and 719 enter the analyzer 750 and mass spectra are produced. A computer 760 controls the entire analysis and collects the data.

Samples are injected into the transfer lines 703, 705, 707 and 709 via the injection loops 73, 75, 77 and 79. Solvent (not shown) of substantially the same composition as that of the sample solution is continuously pumped through the transfer lines 703, 705, 707, and 709 to the sprayers. When a sample solution is injected onto an individual transfer line, the solvent being pumped through that transfer line carries the sample solution to the sprayer 700. The time required for the sample to travel from the injection loop to the sprayer is determined by the volume flow rate of the solvent, f, and the length, l, and inner radius, r, of the of the transfer line as described by Formula I:

$$t=\pi r^2 l/f \qquad \text{(I)}$$

Alternatively, the time required to transfer the sample can be determined experimentally. The length of time for which the sample will be present at the sprayer is given by the volume of sample injected divided by the volume flow rate of the solvent. Knowing these values, the injection of the samples, the sprays, and data acquisition can be synchronized as depicted in FIGS. 8 and 9.

Figure 8:
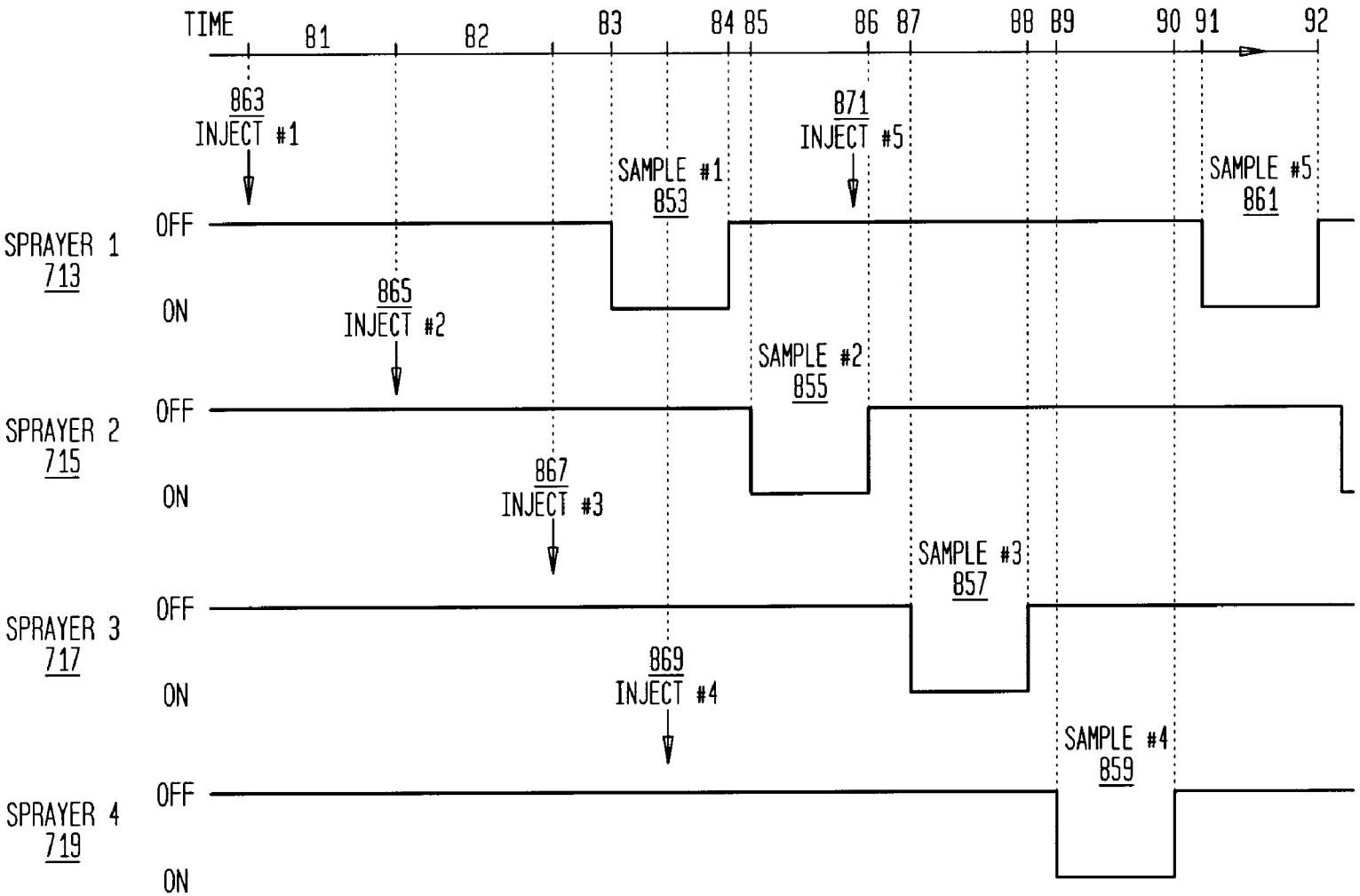
FIG. 8 is a timing diagram for the multiplexed sample injection setup of FIG. 7.
Figure 9:
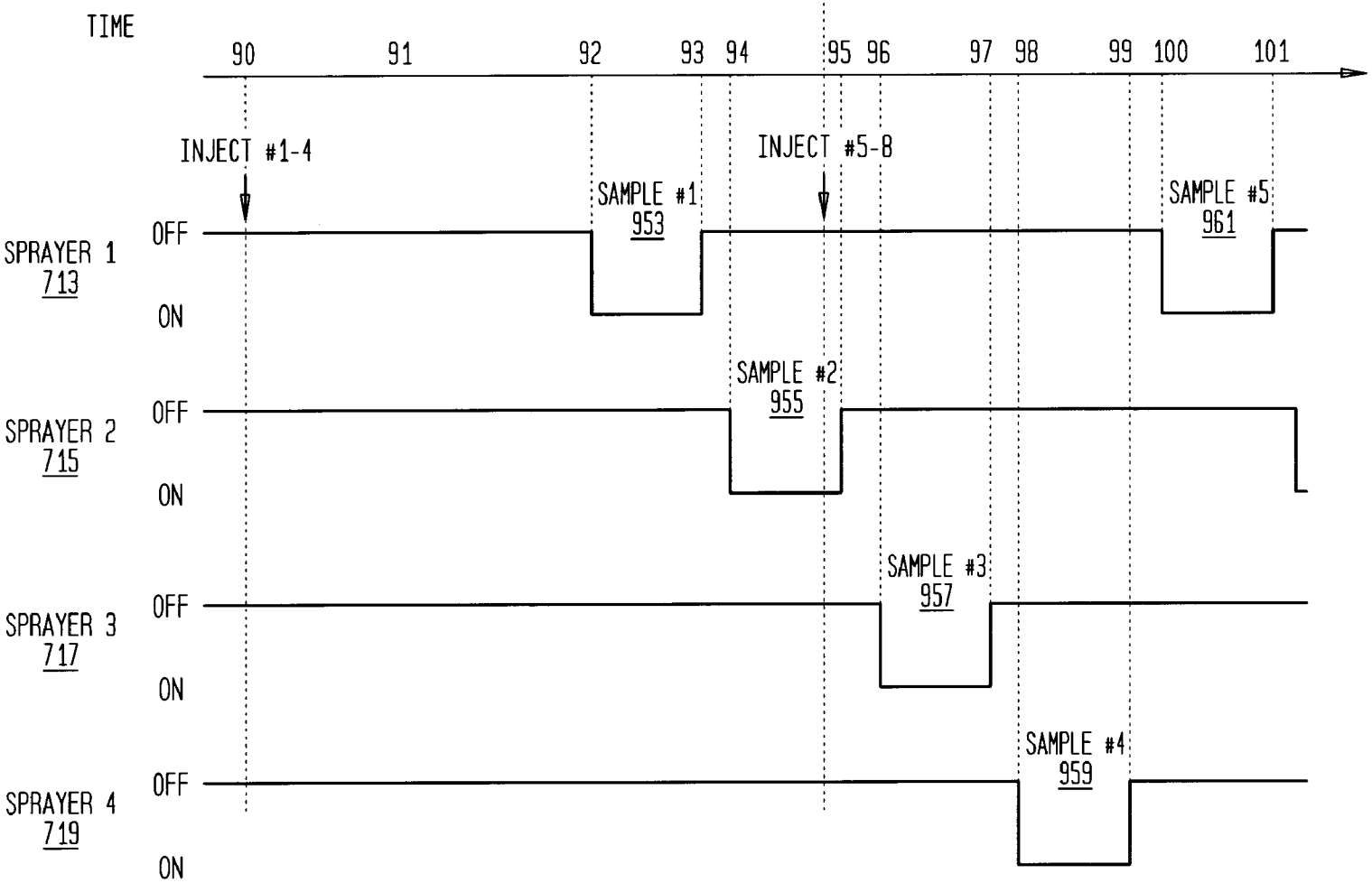
FIG. 9 is a timing diagram for an alternate embodiment multiplexed sample injection setup of FIG. 7 wherein the transfer lines are of differing lengths.

FIG. 8 depicts the synchronization of the sample injection, spray, and data acquisition depicted in FIG. 7 assuming the transfer lines are the same lengths and diameters, the flow rates of the solvent in the transfer lines is the same in all the transfer lines, and the volume of sample injected is the same for all samples. As depicted, a first sample 853 is injected via a first injection loop 73 into a first transfer line 703 at inject time 863. After a predetermined time a second sample 855 is injected via a second injection loop 75 into a second transfer line 705 at inject time 865. The time delay 81 between the first injection 863 and the second injection 865 is chosen to be to the length of time that which the first sprayer 713 (time 83) will be turned "on" an 715 to be turned on (time 85). That is, it is irrelevant whether the sample remains within the system, so long as the time delay 81 equals the time delay from time 83 to time 85 and exceeds the time that sprayer 713 is turned on (time 83 to time 84). Similarly, the time delay 82 between the injection of the second sample and the third is chosen to be longer than the length of time which the second sample will appear at the second sprayer 715. Assuming the volume of the samples injected is the same for all samples, the time delay 81 between the second injection 865 and the first should be the same as the time delay 82 between the second injection and the third or that between the third and fourth injections.

Initially, all sprayers are "off". That is, solution is flowing through and being nebulized by the sprayers 713, 715, 717 and 719, but the potential applied to the individual sprayer is inadequate to produce an analytically significant number of ions from the spray. The time 83 at which the first sample arrives at the first sprayer is know by the above equation or by previous experiments. At this time 83, the first sprayer 713 is turned "on" by applying an electric potential adequate to produce an analytically useful ion signal. After a predetermined time the first sprayer is turned off (time 84). Similarly, the second sprayer 715 is turned on at time 85 only when the second sample is at the second sprayer 715 and the third and fourth sprayers 717 and 719 are turned on only while the third and fourth samples are at the third and fourth sprayers 717 and 719 respectively, times 87 and 89 respectively. After a predetermined time delay, a fifth sample is injected into the first transfer line 703 via the first injection loop 73 at inject time 871; a sixth sample (not shown) is injected onto the second transfer 705 line via the second injection loop 75 just after the second sample has been sprayed; and so forth.

The purpose for turning the previous off before turning on the subsequent sprayer is to avoid cross-contamination. That is, to prevent reside from an earlier sample to effect the spectrum of a subsequent sample.

A computer 760 coordinates the sample injections and turns the sprayers 716, 715, 717 and 719 on and off. Further the computer 760 directs the mass analyzer 750 to acquire spectra at the appropriate times. That is, a first mass spectrum is acquired while the first sample is being sprayed at the first sprayer 713; a second mass spectrum is acquired while the second sample is being sprayed at the second sprayer 715; etc. The computer 760 acquires the spectra from the analyzer 750 and stores them appropriately.

FIG. 9 depicts a timing diagram according to a similar arrangement as that described with reference to FIGS. 7 and 8. However, with regard to FIG. 9 it is assumed that the lengths and diameters of the transfer lines 703, 705, 707 and 709 of FIG. 7, for example, have been specially chosen so that samples 953, 955, 957 and 959 injected simultaneously onto the four transfer lines will arrive at the ionization chamber 700 in the staggered manner depicted in FIG. 9. Thus a first sample 953, second sample 955, third sample 957, and fourth sample 959 are injected simultaneously onto the first, second, third, and fourth transfer lines respectively (703, 705, 707 and 709) at inject time 90. After a predetermined time delay 91, corresponding to the transfer delay of the first transfer line 703, the first sprayer 713 is turned on at time 92 and the mass analyzer 750 begins to acquire data. The data for sample one 953 is acquired and stored by the computer 760 and the first sprayer 713 is turned off at time 93. The second sprayer 715 is turned on at time 94 as the second sample 953 arrives at the second sprayer 715 and the mass analyzer 750 begins to acquire a second data set. The data for the second sample 955 is stored and the second sprayer 715 is turned off at time 95. This process continues for the remaining two samples and sprayers as discussed above. At a predetermined time 901 (the only restriction is that time 100 is later than time 99 to prevent overlap), a second set of four samples is injected onto the four transfer lines 703, 705, 707 and 709 so that as data for the second sample 955, third sample 957, and fourth sample 959 are being acquired, the fifth through eighth samples (of which only the fifth sample is depicted as 961) are being transferred to the ionization chamber 700. The injection and transfer of the second set of samples ideally is timed so that the fifth sample 961 arrives at the first sprayer 713 at time 100, shortly after the conclusion of data acquisition from the fourth sample 959.

Figure 10:
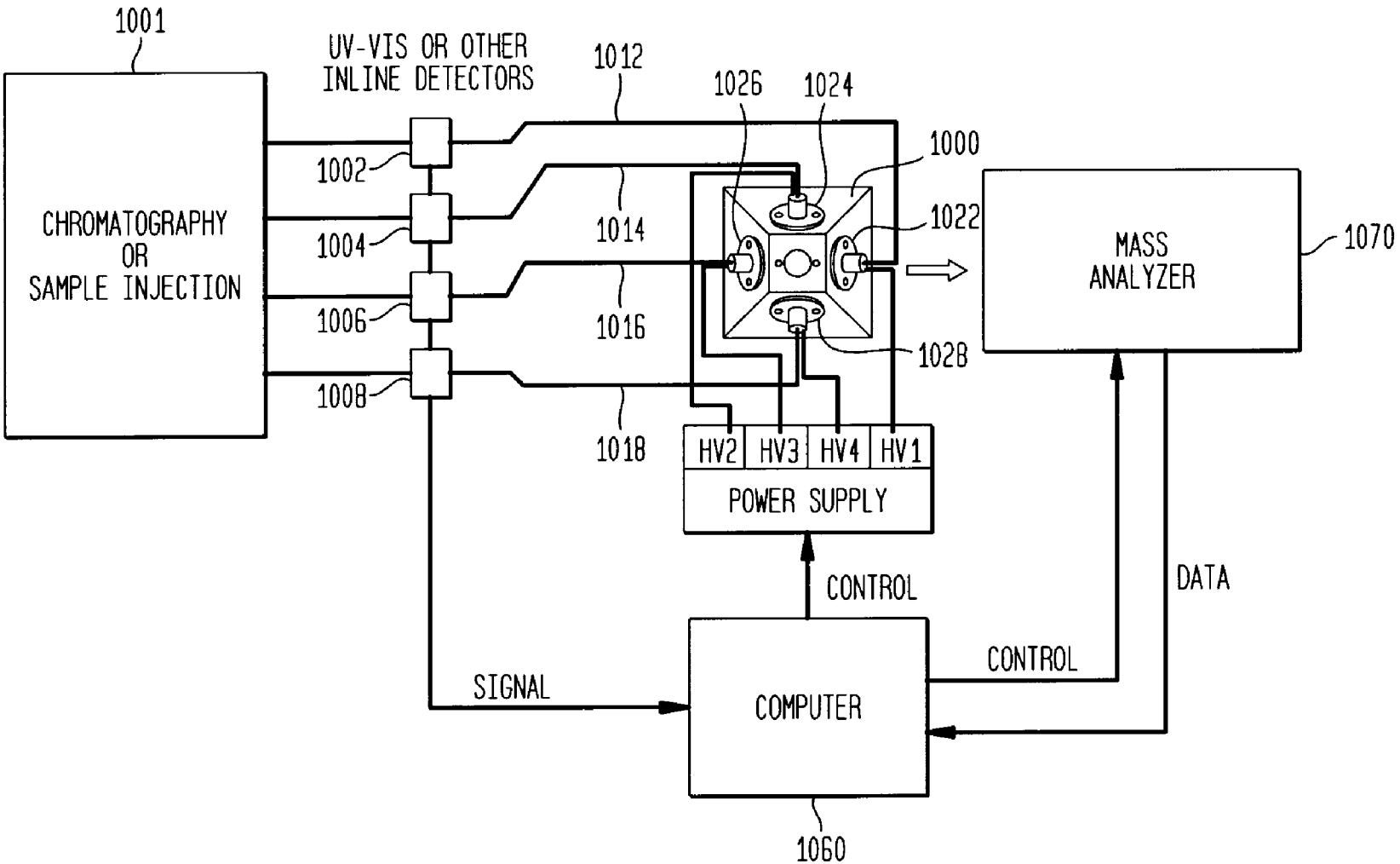
FIG. 10 is a schematic of a setup for multiplexed sample injection employing UV-Vis or other inline chromatographic detector.

FIG. 10 depicts another way in which samples might be multiplexed. Here UV-Vis 1002, 1004, 1006 and 1008 or some other inline chromatographic detectors are used to detect the presence of sample in the transfer lines 1012, 1014, 1016 and 1018. When sample material is detected, the computer 1060, after a predetermined delay required for the sample to move from the detector 1002, 1004, 1006 or 1008 to the respective sprayer 1022, 1024, 1026 and 1028, turns on the appropriate sprayer. The computer 1060 leaves the appropriate sprayer on for the same length of time that the detector detects sample in the transfer line. The computer 1060 also activates the mass analyzer 1070 and acquires data during this period of time. This method of operation is appropriate for either loop injection of individual samples as described above or for the analysis of the effluent from a multitude of chromatographic columns. Assuming the effluent from four liquid chromatographic (LC) columns 1001 is being fed into the transfer lines 1012, 1014, 1016 and 1018—one LC column per transfer line—the UV-Vis detectors 1002, 1004, 1006 or 1008 would detect the chromatographic "peaks" and the computer 1060 would turn the sprayers 1022, 1024, 1026 and 1028 and mass analyzer 1070 on and off as appropriate to obtain mass spectra of all sample effluent from all LC columns. Further, such spectra might be obtained in a sequential manner such that the evolution of each of the chromatographic separations may be recorded in the form of mass spectra. It may occur that sample material from more than one LC column arrives simultaneously at the ionization chamber 1000. In such a case the computer 1060 would alternate the sprays of those sprayers at which sample appears. For example, if sample material appears at two sprayers simultaneously then the first of those sprayers would be turned on for a short period of time whereas the second is off then the second sprayer would be turned on while the first is off. The sprays would be alternated on and off as frequently as reasonable considering the speed of the mass analyzer 1070 being used. For example, the sprays might be alternated on and off as many as ten times a second assuming a TOF analyzer is used. Of course, the computer 1060 would coordinate the sprays, the mass analyzer 1070 and the storage of data in such a manner that mass spectral data can be readily associated with a given column and sample.

It should be recognized that whereas four transfer lines and sprayers were discussed here with regards to FIGS. 7, 8, and 9, any number of transfer lines and sprayers might be used. Also, whereas the preferred embodiment cover includes five ports at three angles, one might for the purpose of multiplexed sampling, use a cover having a multitude of equivalent ports. That is, all the sprayers would be at the same distance and angle from the orifice and the sprayers would be arranged in a cylindrically symmetric manner around the sampling orifice. This would insure a substantially identical behavior from every sprayer.

Figure 11:
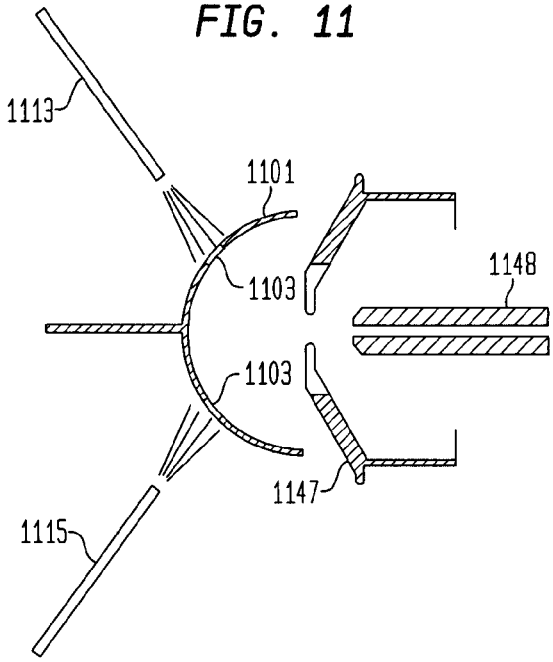
FIG. 11 a schematic of and alternate embodiment ionization chamber wherein a low voltage shield is used.

Further, in an alternate embodiment, a low voltage shield 1101 might be used as depicted in FIG. 11. The purpose of the low voltage shield is to electrically shield the sprayers 1113 and 1115 from each other such that the potential on any given sprayer does not influence the spray from any other sprayer. The low voltage shield 1101 is an electrode of substantially spherical shape containing apertures 1103 coinciding with the tips of the spray needles of sprayers 1113 and 1115. The potential of the low voltage shield may be varied, however, in the alternate embodiment shown, the shield is grounded. A high voltage, $V_1$, is then applied to a sprayer to produce ions. For example, in this alternate embodiment to spray positive ions, $V_1$, might be approximately 4 kV. To stop producing ions, $V_1$ is set to zero volts. The potentials on the endcap 1147 and sampling orifice 1148, $V_2$ and $V_3$ respectively, are set to about −2 kV and −2.5 kV to help guide the ions into the sampling orifice 1148.

Figure 12:
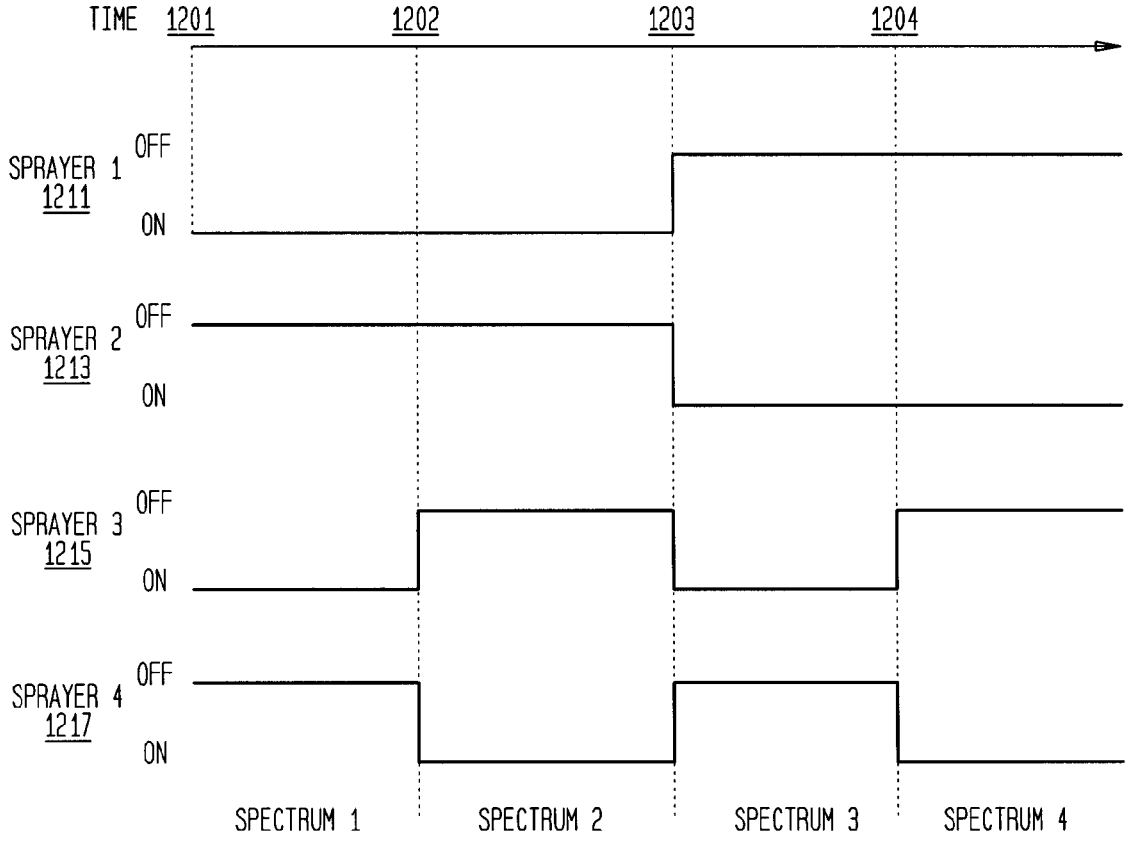
FIG. 12 is a timing diagram for the multiplexing of samples via the Hadamard multiplex method.

In addition to the methods described above with respect to FIGS. 7 through 10, one might also modulate the sprayers to encode the resultant signals in such a way that they can later be deconvoluted. For example, one might employ the Hadamard multiplex method (M. Harwit & N. J. A Sloane, *Hadamard Transform Optics, Academic Press, NY,* 1979). It is assumed in this case that solution containing sample is present at the sprayers throughout the experiment—one sample solution per sprayer. To encode the signal, the sprayers are turned "on" and "off" in a known sequence. For example, FIG. 12 depicts a sequence whereby at time 1201, or the start time, sprayers 1211 and 1215 are "on" and sprayers 1213 and 1217 are "off". At time 1202, the status of sprayers 1211 and 1213 remains unchanged, and sprayers 1215 and 1217 reverse—that is, sprayer 1215 is "off" and sprayer 1217 is "on". At time 1203, the status of all the sprayers change so that sprayers 1211 and 1215 are "off" and sprayers 1213 and 1217 are "on". At time 1204, the status of the sprayers 1211 and 1213 remain unchanged and sprayers 1215 and 1217 change so that sprayer 1215 is "off" and sprayer 1217 is "on".

Roughly half of the sprayers will be on at any given time. The order in which the sprayers are turned on and off may be determined by a cyclic permutation. Assuming four sprayers and four sample solutions, four spectra would be obtained. Each spectrum is essentially an array of intensity vs. mass. For each individual mass in the array the results of the four measurements are "transformed" via a Hadamard transform to produce the intensity of the ion signal at that mass produced by each sprayer. By transforming the results obtained for each and every individual mass represented in the raw data, mass spectra for the individual sprayers can be recovered. The advantage of performing the measurement in this way is that each individual sprayer can be sampled for a longer period of time—roughly half of the time required to complete the experiment—than if the same number of samples were sprayed sequentially in the same time period. This results in a better signal-to-noise ratio in the transformed spectra and presumably lower detection limits. It should be noted that the production of ions might also be modulated by turning the flow of the sample solution on and off.

Finally, it should be noted that whereas the preferred embodiment ionization chamber has a multitude of ports and that the sprayers or other devices are mounted on the cover via these ports, it is possible as an alternate embodiment to have these devices integrated into the cover—i.e. built into the cover without the use of a port. Such an embodiment will not have the flexibility of the preferred embodiment, however, it retains the advantage over prior art of the multiple sprayers and the ability to multiplex the sprays and samples in a manner such as is discussed herein with respect to FIGS. 7 through 10 and FIG. 12.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

What is claimed is:

1. A cover for an ionization source of a mass spectrometer, said cover comprising a plurality of device ports, and a means for attaching said cover to a region of said mass spectrometer such that sample ions may be introduced into a sampling orifice, wherein an endcap is mounted over said sampling orifice and wherein a low voltage shield is located between said endcap and said ports.

2. A cover according to claim 1, wherein said low voltage shield comprises an electrode.

3. A cover according to claim 1, wherein the shape of said low voltage shield is substantially semi-spherical.

4. A cover according to claim 1, wherein said low voltage shield contains apertures.

5. A cover according to claim 4, wherein said apertures correspond to said axes of said ports.

6. A cover according to claim 1, wherein a potential is applied to said low voltage shield.

7. A cover according to claim 1, wherein said low voltage shield is grounded.

8. A cover according to claim 1, wherein said cover and said ionization source are used in conjunction with a mass analyzer.

9. A cover according to claim 8, wherein said mass analyzer is a time-of-flight mass analyzer.

10. A cover according to claim 8, wherein said mass analyzer is a FT-ICR mass analyzer.

11. A cover according to claim 8, wherein said mass analyzer is a quadrupole ion trap mass analyzer.

12. A cover according to claim 8, wherein said mass analyzer is a linear quadrupole mass analyzer.

13. A cover according to claim 1, wherein one of said device ports is coaxial with an axis of said ionization source.

14. A cover according to claim 13, wherein a sprayer is mounted in said coaxial device port.

15. A cover according to claim 14, wherein said sprayer is an electrosprayer.

16. A cover according to claim 14, wherein said sprayer is a microsprayer.

17. A cover according to claim 14, wherein said sprayer is a nanosprayer.

18. A cover according to claim 1, wherein said device ports are positioned at predetermined angles with respect to an axis of said ionization source.

19. A cover according to claim 18, wherein said predetermined angles are in the range of 0 to 90 degrees.

20. A cover according to claim 18, wherein one of said device ports is coaxial with said ionization source.

21. A cover according to claim 1, wherein said device ports have approximately equal dimensions.

22. A cover according to claim 1, wherein said cover is removable.

23. A cover according to claim 1, wherein devices are positioned in said device ports.

24. A cover according to claim 23, wherein said devices operate simultaneously.

25. A cover according to claim 23, wherein said devices are controlled by a computer.

26. A cover according to claim 23, wherein said devices are interchangeable between said ports.

27. A cover according to claim 23, wherein at least two of said devices are aligned such that their respective axes intersect at a common point.

28. A cover according to claim 23, wherein said devices are selected from the group consisting of electrosprayers, nanosprayers, microsprayers, ESI needles, corona discharge needles, nebulizers, ionization probes, equipment for analysis, recording devices, flanges, and illumination devices.

29. A cover according to claim 23, wherein said devices are in electrical contact with said cover.

30. A cover according to claim 1, wherein at least two of device said ports each have longitudinal axes therethrough, said axes intersecting at a common point.

31. A cover according to claim 1, wherein said sampling orifice is located substantially near said common point.

32. A cover according to claim 1, wherein said endcap is located substantially near said sampling orifice.

33. A cover according to claim 32, wherein said endcap comprises slits.

34. A cover according to claim 33, wherein said slits correspond to said device ports.

35. A cover according to claim 33, wherein said slits are aligned with said device ports.

36. A cover according to claim 1, wherein a voltage is applied to said endcap.

37. A cover according to claim 1, wherein a high voltage shield is located between said endcap and said device ports.

38. A cover according to claim 37, wherein said high voltage shield comprises an electrode.

39. A cover according to claim 37, wherein said high voltage shield has substantially the same shape as said cover.

40. A cover according to claim 37, wherein a potential is applied to said high voltage shield.

41. A cover according to claim 37, wherein a potential is applied to said endcap.

* * * * *